US008407937B2

(12) United States Patent
Houser

(10) Patent No.: US 8,407,937 B2
(45) Date of Patent: Apr. 2, 2013

(54) DOOR OPERATOR

(75) Inventor: Blue Houser, Edgemoor, SC (US)

(73) Assignee: Yale Security Inc., Monroe, NC (US)

( * ) Notice: Subject to any disclaimer, the term of this patent is extended or adjusted under 35 U.S.C. 154(b) by 378 days.

(21) Appl. No.: 12/603,871

(22) Filed: Oct. 22, 2009

(65) Prior Publication Data

US 2011/0094160 A1 Apr. 28, 2011

(51) Int. Cl.
*E05F 15/00* (2006.01)

(52) U.S. Cl. ..... 49/139; 49/346; 49/341

(58) Field of Classification Search ..... 49/139, 49/140, 339, 340, 341, 346
See application file for complete search history.

(56) References Cited

U.S. PATENT DOCUMENTS

| | | | |
|---|---|---|---|
| 581,972 | A | 5/1897 | Wright |
| 618,053 | A | 1/1899 | Brown |
| 2,138,521 | A | 11/1938 | Ellis |
| 2,639,142 | A | 5/1953 | Morgan et al. |
| 2,758,835 | A | 8/1956 | Wikkerink |
| 2,843,376 | A | 7/1958 | Osuch et al. |
| 2,924,449 | A | 2/1960 | Leimer et al. |
| 3,059,485 | A | 10/1962 | Bohlman et al. |
| 3,114,541 | A | 12/1963 | Coffey |
| 3,195,879 | A | 7/1965 | Bond et al. |
| 3,268,944 | A | 8/1966 | Sanchez |
| 3,284,950 | A | 11/1966 | Gute |
| 3,449,789 | A | 6/1969 | Russell et al. |
| 3,470,653 | A | 10/1969 | Kalog |
| 3,560,950 | A | 2/1971 | Peters |
| 3,609,390 | A | 9/1971 | Feldman |
| 3,719,005 | A | 3/1973 | Carli |
| 3,777,423 | A | 12/1973 | Coulter et al. |

(Continued)

FOREIGN PATENT DOCUMENTS

| | | |
|---|---|---|
| CH | 677563 | 5/1999 |
| DE | 20218327 | 5/2004 |

(Continued)

OTHER PUBLICATIONS

Yale Security, Inc., International Patent Application No. PCT/US2005/023398, International Search Report and Written Opinion, Aug. 20, 2007.

(Continued)

*Primary Examiner* — Jerry Redman
(74) *Attorney, Agent, or Firm* — Michael G. Johnston; Matthew W. Witsil; Moore & Van Allen PLLC

(57) ABSTRACT

A door operator for selectively opening and closing a side hinge door. The door operator may include a motor with a drive shaft, an operator arm assembly, a door position sensor, and a controller. The operator arm assembly may include an output shaft operatively coupled to the drive shaft, an operator arm, and a clutch assembly mounted to the output shaft. The door position sensor, which may be electro-magnetic, signals the controller when the door is not closed. If the door has been manually pushed open, the controller signals the motor to rotate the drive shaft in the closing direction. In automatic mode, the output shaft and the operator arm are operatively engaged, but manual force to open the door overcomes static friction between the operator arm and friction discs in the clutch assembly, operatively disengaging the operator arm and output shaft until the manual force is removed.

32 Claims, 8 Drawing Sheets

U.S. PATENT DOCUMENTS 3,874,117 A 4/1975 Boehm
3,886,425 A 5/1975 Weiss
3,955,661 A 5/1976 Popper et al.
4,045,914 A 9/1977 Catlett
4,161,183 A 7/1979 Berry
4,220,051 A 9/1980 Catlett
4,222,147 A 9/1980 Burnett, Jr.
4,267,619 A 5/1981 Suska
4,285,094 A 8/1981 Levings, Jr.
4,289,995 A 9/1981 Sorber et al.
4,330,958 A 5/1982 Richmond
4,333,270 A 6/1982 Catlett
4,334,161 A 6/1982 Carli
4,342,354 A 8/1982 Leivenzon et al.
4,348,835 A 9/1982 Jones et al.
4,429,490 A 2/1984 Zunkel
4,472,910 A 9/1984 Iha
4,498,033 A 2/1985 Aihara et al.
4,501,090 A 2/1985 Yoshida et al.
4,553,656 A 11/1985 Lense
4,563,625 A 1/1986 Kornbrekke et al.
4,573,238 A 3/1986 Phillips
4,644,693 A 2/1987 Wang
4,658,545 A 4/1987 Ingham et al.
4,660,324 A 4/1987 Nyenbrink
4,669,218 A 6/1987 Kornbrekke et al.
4,697,383 A 10/1987 Hagiwara
4,727,679 A 3/1988 Kornbrekke et al.
4,836,345 A 6/1989 Anderson
4,852,706 A 8/1989 Pietrzak et al.
4,945,678 A 8/1990 Berner et al.
4,952,080 A 8/1990 Boiucaner et al.
4,966,266 A 10/1990 Yamada et al.
4,972,629 A 11/1990 Meredino et al.
4,979,261 A * 12/1990 Lasier et al. ..... 16/62
4,995,194 A 2/1991 Schultze et al.
4,999,551 A 3/1991 Yoshida et al.
5,018,304 A 5/1991 Longoria
5,024,124 A 6/1991 Popov et al.
5,040,331 A 8/1991 Merendino et al.
5,095,654 A 3/1992 Eccleston
5,218,282 A 6/1993 Duhame
5,221,239 A 6/1993 Catlett
5,222,327 A 6/1993 Fellows et al.
5,278,480 A 1/1994 Murray
5,375,374 A 12/1994 Rohraff, Sr.
5,392,562 A * 2/1995 Carambula ..... 49/346
5,502,874 A 4/1996 Lucas
5,507,120 A 4/1996 Current
5,513,467 A 5/1996 Current et al.
5,634,296 A 6/1997 Hebda
5,634,298 A 6/1997 Slopack
5,698,073 A 12/1997 Vincenzi
5,752,344 A 5/1998 Richmond
5,770,934 A 6/1998 Theile
5,808,654 A 9/1998 Loos
5,828,302 A 10/1998 Tsutsumi et al.
5,878,530 A 3/1999 Eccleston et al.
5,881,497 A 3/1999 Borgardt
5,910,075 A 6/1999 Arnell et al.
5,930,954 A 8/1999 Hebda
5,956,249 A 9/1999 Beran et al.
5,963,000 A 10/1999 Tsutsumi et al.
5,987,818 A 11/1999 Dabideen
6,002,217 A 12/1999 Stevens et al.
6,006,475 A 12/1999 Schwantes et al.
6,067,753 A 5/2000 Hebda
6,108,975 A 8/2000 Bailey
6,185,773 B1 2/2001 Goedde
6,223,469 B1 5/2001 Moll
6,316,892 B1 11/2001 Valencia
6,318,196 B1 11/2001 Chang
6,323,424 B1 11/2001 He
6,336,294 B1 1/2002 Kowalczyk et al.
6,343,437 B1 2/2002 Hoffman et al.
6,347,485 B1 2/2002 Hebda
6,357,805 B1 3/2002 Hebda
6,430,871 B1 8/2002 Hebda
6,481,160 B1 11/2002 Kowalczyk
6,493,904 B1 12/2002 Chiang
6,553,717 B2 4/2003 St. John et al.
6,588,153 B1 7/2003 Kowalczyk
6,634,140 B1 10/2003 Sellman
6,640,494 B2 11/2003 Hormann
6,678,999 B2 1/2004 Zeungguang et al.
6,751,909 B2 6/2004 Ranaudo
6,883,275 B2 4/2005 Hellinga et al.
6,891,479 B1 5/2005 Eccleston
7,068,179 B2 6/2006 Snell et al.
7,170,248 B2 1/2007 Tsui et al.
7,234,201 B2 6/2007 Brown et al.
7,296,380 B2 11/2007 Backman
7,316,096 B2 1/2008 Houser et al.
7,324,894 B2 1/2008 Urman et al.
7,373,756 B2 * 5/2008 Okulov et al. ..... 49/346
7,418,800 B1 9/2008 Sellman
7,484,333 B2 2/2009 Houser et al.
7,570,222 B2 * 8/2009 King ..... 343/765
7,740,047 B2 * 6/2010 Koop et al. ..... 160/323.1
2002/0092237 A1 7/2002 Hebda
2003/0204935 A1 11/2003 Kim
2004/0035057 A1 2/2004 Backman
2004/0129810 A1 * 7/2004 Kasprowicz et al. ..... 241/101.2
2004/0251868 A1 12/2004 Sato et al.
2005/0073425 A1 4/2005 Snell et al.
2005/0091928 A1 5/2005 Okulov et al.
2006/0021189 A1 2/2006 Johnson
2006/0090400 A1 5/2006 Los et al.
2006/0191204 A1 8/2006 Herwig et al.
2006/0242908 A1 11/2006 McKinney
2008/0115543 A1 5/2008 Lanigan et al.
2008/0236048 A1 10/2008 Kowalczyk et al.
2009/0139146 A1 6/2009 Houser et al.
2009/0300988 A1 12/2009 Bem

FOREIGN PATENT DOCUMENTS

EP 0217228 B1 12/1989
FR 2508530 12/1982
JP 1296399 11/1989
JP 4131488 A 5/1992
JP 6033994 2/1994
JP 9209652 8/1997
JP 11324483 11/1999
JP 2001090431 4/2001
JP 2002174073 6/2002
JP 2004244882 9/2004
JP 2008022965 2/2008
JP 2009270278 11/2009
WO WO 2005119247 12/2005

OTHER PUBLICATIONS

Yale Security, Inc., International Patent Application No. PCT/US2005/023398, International Preliminary Report on Patentability, Sep. 20, 2007.

Sky Link, Add Remote Control to any Swinging Door, www.smarthome.com/73105/Swing-Door-Opener-w-Electric-Strike-Automatic-Door-Security/p. aspx, 3 pages, visited May 13, 2010.

JPM Security Systems, Wheelchair Accessible Door/Window Access Systems for Disabled or Elderly People, www.jpmsecurity.ie/index.php?page=disabled-door-access, 3 pages, visited May 13, 2010.

Nabco,Ltd., Nabco Entrances Swing Doors, www.floridadoorcontrol.com/nabco__swing__doors.htm, 3 pages, visited Oct. 7, 2009.

The Stanley Works, Swing Door Systems, www.stanleyaccesstechnologies.com/products/lit/Swing%20Door%20Series%20AT9706.pdf, 4 pages, visited Oct. 7, 2009.

Product Review, Home & Garden, Garage Door Operators, Boss BS1, www.productreview.com.au, 1 page, visited Jun. 17, 2009.

Christy Commercial Hardware, Jackson Closers, www.christyhardware.com, 1 page, visited Jun. 17, 2009.

* cited by examiner

DOOR OPERATOR

BACKGROUND

The purpose of a door operator is to open and close a door. Automatic door operators are used on public buildings and residences to allow for access by the physically disabled or where manual operation of the door may be inconvenient to users. In public facilities, it is a required American National Standard for doors that provide ingress and egress to have the ability to open automatically in order to allow handicapped people passage through the doorway.

A variety of electro-mechanical automatic door operators are known. A typical door operator includes an electric motor and a linkage assembly for operatively coupling the drive shaft of the motor to a door so that the door will be opened and closed when the drive shaft rotates. Activation of the door operator is initiated by means of an electric signal generated in a variety of ways such as, for example, a pressure switch, an ultrasonic or photoelectric presence sensor, motion sensors, radio transmitters, wall switches, and the like. The door may then be closed under power or with a door closer. A conventional door closer uses an internal spring mechanism which is compressed during the opening of the door for storing sufficient energy so that the door can be returned to a closed position without the input of additional electrical energy. In the some door operators, the automatic, powered opening system is still engaged once the closing sequence starts, and consequently the spring force of the door closer must overcome the resistance caused by counter-rotating the gear train coupled to the motor. Since this spring force must be large, an individual manually opening the door must exert substantial force to overcome the spring force and the resistance forces generated by the opening system. Moreover, driving the components of the powered opening system during manual opening and closing of the door causes the gear train to become worn more quickly over time.

Some door operator systems are provided with clutch mechanisms between the motor and the linkage assembly that enable the door to be moved freely under manual power. Door operators with clutch mechanisms may provide some level of safety when objects are in the door's pathway of movement. Various clutch mechanisms decouple powered opening systems during the closing cycle, which is particularly necessary in the event of an interruption of power supply or when an obstacle is encountered. Some require a sensor mounted in the motor housing or drive shaft to sense stoppage of the door by an obstacle and to disengage the clutch or stop the motor so as to prevent damage to the device or obstacle. This solution still presents problems. For example, a door operator utilizing a slip clutch or the like will create some drag or resistance when the door is manually opened or closed. Moreover, conventional clutch mechanisms that do not create resistance suffer from a limited range of motion.

Other known automatic door operator systems enable a user to open the door under automatic power or under manual power, and the systems use a predetermined, elapsed time in between opening and closing sequences. Under automatic power, a motor is operated by a controller and opens at a particular speed and direction. The motor may then stall or rest for the fixed, predetermined period. At the expiration of such time period, the controller then signals the motor to reverse direction and close the door under power. Under manual operation, the door is opened by the user. Once the user releases the door, which may be before the door has reached the fully open position, the controller may direct the motor to continue to open the door until reaching the fully open position, despite that the user may have already moved through the doorway. This operation may not be desirable in cases where the door is an outside door and the weather conditions cause considerable heat loss in the winter or heat gain in the summer. Moreover, security at building entrances may be a concern. Automatic door operator systems that delay return of a manually opened door to the closed position beyond the time needed for a person to move through the doorway create a heightened security risk, as there may be an extended opportunity for entry by an unauthorized person.

SUMMARY

In accordance with one embodiment of a door operator, a door operator for selectively operating a door positioned within a door frame and hinged along one edge to the door frame for movement between a closed position and a fully open position is provided. The door operator includes a motor and an operator arm assembly. The motor includes a drive shaft rotatable in a first direction adapted to open the door and in a second direction adapted to close the door. The operator arm assembly includes an output shaft operatively coupled to the drive shaft, a rotatable operator arm, and a clutch assembly. The rotatable operator arm defines an opening through which the output shaft passes and is adapted to be operatively connected to the door. The operator arm is adapted to have a closed position coincident with the closed position of the door and a fully open position coincident with the fully open position of the door. The clutch assembly is mounted to the output shaft and is conditionally operatively engageable with the operator arm. When a force is manually applied to move the operator arm towards the fully open position, the output shaft and operator arm are not operatively engaged, and when no manual force is applied the output shaft and the operator arm are operatively engaged.

The door operator may further include a door position sensor and a controller. The door position sensor may be for sensing the position of the operator arm. The controller may be in communication with the motor and the door position sensor. When the operator arm is manually moved towards the fully open position from the closed position, the operator arm operatively disengages from the clutch assembly, the sensor indicates to the controller that the operator arm position is not closed, the controller signals to the motor to rotate the drive shaft in the direction adapted to close the door, and the motor rotates the drive shaft in the direction adapted to close the door. The controller may further receive a signal for the door operator to move the operator arm towards the fully open position automatically and the motor may power the operator arm to reach a fully open position. The door position sensor may then indicate to the controller that the operator arm is in the fully opened position and the controller, either immediately or after a delay, may send a signal to the motor to reverse rotation of the drive shaft so as to cause the operator arm to move to the closed position. The door position sensor may then indicate to the controller when the operator arm is in the closed position, and the controller may send a signal to the motor to cease rotation of the drive shaft.

In accordance with another embodiment of a door operator, another door operator for selectively operating a door positioned within a door frame and hinged along one edge to the door frame for movement between a closed position and a fully open position is provided. The door operator includes a motor including a drive shaft rotatable in a first direction adapted to open the door and in a second direction adapted to close the door. An operator assembly includes an output shaft operatively coupled to the drive shaft, a rotatable operator arm defining an opening through which the output shaft passes and adapted to be operatively connected to the door, and means for conditionally operatively engaging the output shaft with the operator arm. The operator arm is adapted to have a closed position coincident with the closed position of the door and a fully open position coincident with the fully open position of the door. When a force is manually applied to move the operator arm towards the fully open position, the output shaft and operator arm are not operatively engaged, and when no manual force is applied the output shaft and the operator arm are operatively engaged. Means for sensing the position of the operator arm and a controller in communication with the motor and the sensing means are provided.

In accordance with another embodiment of a door operator, another door operator for selectively operating a door positioned within a door frame and hinged along one edge to the door frame for movement between a closed position and a fully open position is provided. The door operator includes a motor including a drive shaft rotatable in a first direction adapted to open the door and in a second direction adapted to close the door, a operator arm assembly, an electro-magnetic door position sensor, a first magnet, and a controller. The operator arm assembly includes an output shaft operatively coupled to the drive shaft and a rotatable operator arm. The rotatable operator arm defines an opening through which the output shaft passes and is adapted to be operatively connected to the door. The operator arm is adapted to have a closed position coincident with the closed position of the door and a fully open position coincident with the fully open position of the door. The electro-magnetic door position sensor is for sensing the position of the operator arm, and the first magnet rotates about the axis of the output shaft as the output shaft turns, demarcating the closed position of the operator arm. The controller is in communication with the motor and the door position sensor. The door operator may further include a second magnet that rotates about the axis of the output shaft as the output shaft turns and is angularly spaced from the first magnet relative to the axis of the output shaft, as the second magnet demarcates the fully open position of the operator arm.

In accordance with another embodiment of a door operator, another door operator for selectively operating a door positioned within a door frame and hinged along one edge to the door frame for movement between a closed position and a fully open position is provided. The door operator includes a motor including a drive shaft rotatable in a first direction adapted to open the door and in a second direction adapted to close the door, an operator arm assembly, a support member, and a level. The operator arm assembly includes an output shaft operatively coupled to the drive shaft and a rotatable operator arm. The operator arm defines an opening through which the output shaft passes and is adapted to be operatively connected to the door. The operator arm is adapted to have a closed position coincident with the closed position of the door and a fully open position coincident with the fully open position of the door. The support member is for directly or indirectly supporting the motor and is adapted to be mounted to a door frame or structure proximate to the door frame. The level is mounted to the support member.

In accordance with an embodiment of a door assembly, a door assembly is provided and includes a door operator and a door positioned within a door frame and hinged along one edge to the door frame for movement between a closed position and a fully open position. The door operator includes a motor including a drive shaft rotatable in a first direction to open the door and in a second direction to close the door, an operator arm assembly, a door position sensor, and a controller. The operator arm assembly includes an output shaft operatively coupled to the drive shaft, a rotatable operator arm defining an opening through which the output shaft passes, with the operator arm operatively connected to the door, and a clutch assembly. The clutch assembly is mounted to the output shaft and is conditionally operatively engageable with the operator arm. The clutch assembly includes at least one friction disc on each side of the operator arm and parts adjacent to the friction discs, and a spring for biasing the friction discs and the operator arm towards each other for transfer of rotation of the output shaft to the operator arm through static friction. The operator arm may be an adjacent part to at least one friction disc. The output shaft passes through the friction discs, adjacent parts, the operator arm, and the spring. The door position sensor is for sensing the position of the operator arm. The controller is in communication with the motor and the sensor. When the door is manually pushed open from the closed position, parts adjacent to the friction discs slide against the friction discs, the door position sensor indicates to the controller that the door is not closed, the controller signals to the motor to rotate the drive shaft in the direction that closes the door, and the motor rotates the drive shaft in such direction.

In accordance with another embodiment of a door operator, a method of using a door operator for selectively operating a door positioned within a door frame and hinged along one edge to the door frame for movement between a closed position and a fully open position is provided. The door operator includes a motor including a drive shaft, an output shaft operatively coupled to the drive shaft, a rotatable operator arm defining an opening through which the output shaft passes and adapted to be operatively connected to the door, a clutch assembly mounted to the output shaft and including at least one friction disc on each side of the operator arm and parts adjacent to the friction discs, a sensor for sensing the position of the operator arm, and a controller in communication with the motor and the sensor. The operator arm may be an adjacent part to at least one friction disc. The method includes manually pushing the door from a closed position towards the fully open position. The force of static friction between parts adjacent to the friction discs and the friction discs is overcome to initiate movement of the door, operatively disengaging the operator arm from the output shaft.

In accordance with another embodiment of a door operator, a method of making a door operator for selectively operating a door positioned within a door frame and hinged along one edge to the door frame for movement between a closed position and an open position is provided. The method includes providing a motor including a drive shaft. An operator arm assembly is provided including an output shaft operatively coupled to the drive shaft, a rotatable operator arm defining an opening through which the output shaft passes and adapted to be operatively connected to the door, and a clutch assembly mounted to the output shaft and conditionally operatively engageable with the operator arm. The operator arm is adapted to have a closed position coincident with the closed position of the door and a fully open position coincident with the fully open position of the door. When a force is manually applied to move the operator arm towards the fully open position, the output shaft and operator arm are not operatively engaged, and when no manual force is applied the output shaft and the operator arm are operatively engaged. A door position sensor is provided for sensing the position of the operator arm, and a controller in communication with the motor and the sensor is provided. The motor, operator arm assembly, and the controller are assembled.

In accordance with another embodiment of a door operator, a method of installing a door operator for selectively operating a door positioned within a door frame and hinged along one edge to the door frame for movement between a closed position and an open position is provided. The door operator includes a support member, a motor mounted directly or indirectly to the support member and including a drive shaft, an output shaft operatively coupled to the drive shaft, a rotatable operator arm defining an opening through which the output shaft passes and adapted to be operatively connected to the door, a clutch assembly mounted to the output shaft and including at least one friction disc on each side of the operator arm and parts adjacent to the friction discs, through all of which the output shaft passes, a spring to bias the friction discs and the operator arm together, a retaining nut to apply adjustable force to the spring, a sensor for sensing the position of the operator arm and door, and a controller mounted to the support member and in communication with the motor and the sensor. The operator arm may be an adjacent part to at least one friction disc. The method includes mounting the support member to a door frame or building structure proximate to the door frame. The operator arm is operatively connected to the door. The retaining nut is tightened to a torque that applies pressure to the friction discs and the operator arm sufficient to maintain operative engagement of the friction discs and adjacent parts when the door is powered by the motor. The applied torque allows static friction between the friction discs and at least two adjacent parts to be overcome when the operator arm is moved towards the open position manually, operatively disengaging the friction discs and at least two adjacent parts.

In accordance with another embodiment of a door operator, another method of installing a door operator for selectively operating a door positioned within a door frame and hinged along one edge to the door frame for movement between a closed position and an open position is provided. The door operator includes a support member, a motor mounted directly or indirectly to the support member and including a drive shaft, an output shaft operatively coupled to the drive shaft, a rotatable operator arm defining an opening through which the output shaft passes and adapted to be operatively connected to the door, an electro-magnetic door position sensor for sensing the position of the operator arm, and a controller mounted to the support member and in communication with the motor and the sensor. The method includes mounting the support member to a door frame or building structure proximate to the door frame. The operator arm is operatively connected to the door, and a first magnet is disposed on a member that rotates around the axis of the output shaft. When the door is in the closed position the first magnet actuates the sensor. The method may further include disposing a second magnet on the member that rotates around the axis of the output shaft. The second magnet may be angularly spaced from the first magnet relative to the central axis of the output shaft, and when the door is in the fully open position the second magnet actuates the sensor.

In accordance with another embodiment of a door operator, another method of installing a door operator for selectively operating a door positioned within a door frame and hinged along one edge to the door frame for movement between a closed position and a fully open position is provided. The door operator includes a motor and a support member for directly or indirectly supporting a motor. An integral level is mounted to the support member. The method includes placing the support member of the door operator in contact with a door frame or building structure proximate to the door frame for mounting to the door frame or building structure proximate to the door frame. The alignment of the support member is adjusted such that the integral level indicates that the integral level is level, for example, horizontal or vertical. The support member is mounted to the door frame or building structure proximate to the door frame.

BRIEF DESCRIPTION OF THE DRAWINGS

For a more complete understanding of embodiments of a door operator and associated methods, reference should now be had to the embodiments shown in the accompanying drawings and described below. In the drawings.

DESCRIPTION

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures. Indeed, the referenced components may be oriented in any direction and the terminology, therefore, should be understood as encompassing such variations unless specified otherwise.

As used herein, the term "open position" for a door means a door position other than a fully closed position, including any position between the fully closed position and a fully open position as limited only by structure around the door frame, which can be up to 180° from the closed position.

Figure 1:
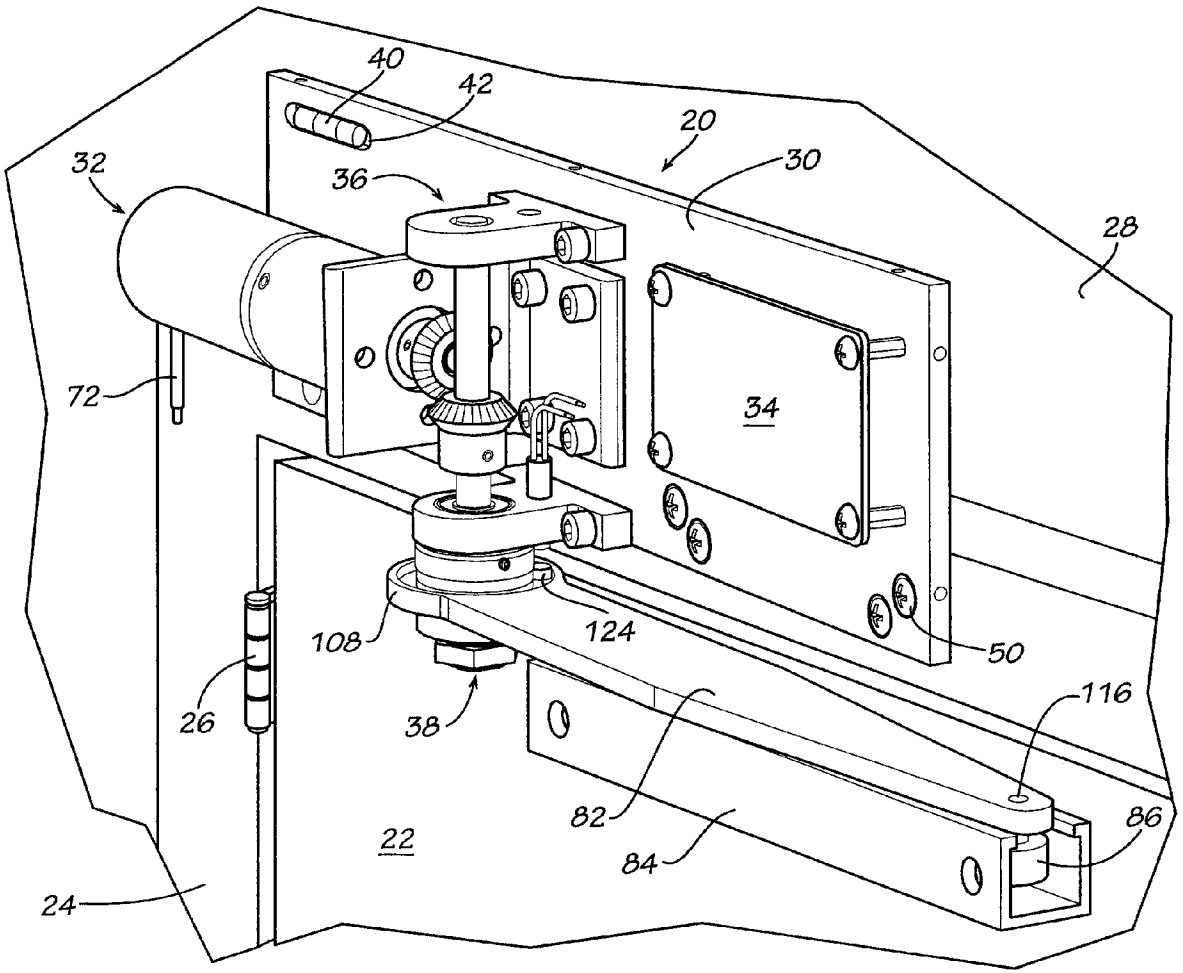
FIG. 1 is a perspective view of one embodiment of an automatic door opener system.

Referring now to the drawings, wherein like reference numerals designate corresponding or similar elements throughout the several views, an embodiment of a door operator is shown in FIG. 1, and is generally designated at 20. The door operator 20 is mounted adjacent to a door 22 in a door frame 24 for movement of the door 22 relative to the frame 24 between a closed position and an open position. For the purpose of this description, only the upper portion of the door 22 and the door frame 24 are shown. The door 22 is of a conventional type and is pivotally mounted to the frame 24 for movement from the closed position, as shown in FIG. 1, to an open position for opening and closing an opening through a building wall 28 to allow a user to travel from one side of the wall 28 to the other side of the wall 28.

Figure 2:
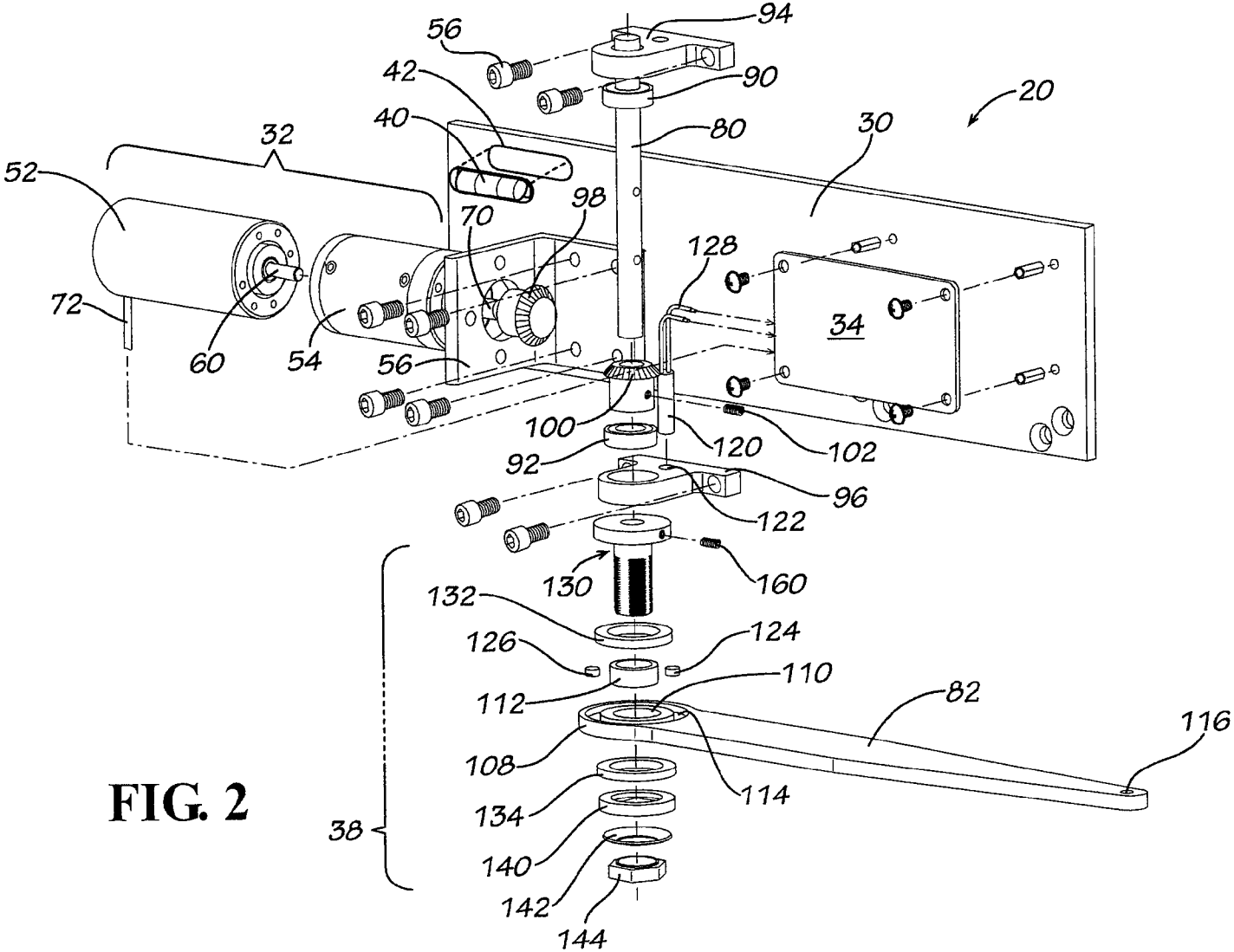
FIG. 2 is an exploded view of the embodiment of FIG. 1.

Referring to FIGS. 1 and 2, the door operator 20 includes a back plate 30, a motor assembly 32, a controller 34, and an operator arm assembly 36 for operably coupling the door operator 20 to a door 22 and including a clutch assembly 38. The orientation of the door 22 and door operator 20 is a pull side configuration, in which the operator arm assembly 36 pulls the door 22 open towards the same side on which the door operator 20 and hinges 26 are disposed. Alternatively, the orientation could be a push side configuration, in which the operator arm assembly may include a linkage of, for example, two arm links to permit the door operator 20 to push the door 22 open in the direction away from the side of the door 22 on which the door operator 20 is located, as is known in the art.

The back plate 30 is securely mounted to the upper edge of the door frame 24 using mounting screws 50, or other fasteners. The back plate 30 extends generally horizontally with respect to the door frame 24. The motor assembly 32, operator arm assembly 36, and controller 34 are mounted to the back plate 30. A bubble level 40 is also mounted to the back plate 30, and may therefore be integral to the back plate 30, to assist an installer in mounting the back plate 30 to the door frame 24 or surrounding structure horizontally. The level 40 may be attached to the back plate 30 with fasteners or adhesive, and a recess 42 may be machined into the back plate 30 to receive the level 40. An installer may use the integral level 40 to adjust the back plate 30 such that the level 40 is "level" before mounting the back plate 40 to the door frame 24. The level 40 may be considered "level," for example, when the bubble indicates that the level 40 is substantially or completely horizontal (as shown in FIG. 1) or vertical, if the level 40 is vertically oriented on the back plate 30.

A cover (not shown) may be attached to the back plate 30 to surround and enclose the components of the door operator 20 that are within the limits of the back plate 30 to reduce dirt and dust contamination, and to provide a more aesthetically pleasing appearance. It is understood that although the back plate 30 is shown mounted directly to the door frame 24, the back plate 30 could be mounted to the wall 28 adjacent the door frame 24, concealed within the wall 28 or door frame 24, or mounted to the door 22 with the operator arm assembly 36 mounted to the door frame. Concealed door operators 20 are well known in the art of automatic door operators.

The motor assembly 32 includes an electric motor 52 and a gear train 54, which may include a planetary gear, mounted to the back plate 30 with a mounting bracket 56 and bolts 58. The motor 52 is a conventional 3 phase AC electric reversible motor with a motor drive shaft 60. A portion of the drive shaft 60 extends from the housing of the motor 52. The motor 52 is reversible such that the rotation of the motor 52 in one direction will cause the drive shaft 60 to rotate in one direction and rotation of the motor 52 in the opposite direction will cause the drive shaft 60 to rotate in the opposite direction. Such motors are widely commercially available and the construction and operation of such motors are well known; therefore, the details of the motor 52 are not described in specific detail herein. A suitable motor for use in the door operator 20 is available from Brother of Somerset, N.J., as model no. BHLM15L-240TC2N, which is a 240 volt motor providing 1/50 HP and a gear ratio of 240:1.

It is understood by those skilled in the art that the electric motor 52 may be selected and sized according to the dimensions and weight of the hinged door 22, and may include a gear train 54 disposed within a casing and include a gear train input shaft (not shown) coupled to the drive shaft 60 of the motor 52. An intermediate shaft 70 that is the output of the gear train 54 is coupled to the gear train input shaft. The gear train 54 may provide a proper reduction in output drive of the motor 52 necessary to move the hinged door 22 at an appropriate speed.

The controller 34 regulates the operation of the motor 52 and thus regulates the opening and closing of the door 22. The controller 34 is in communication with the motor 52, which is adapted to receive signals from the controller 34. Such communication may be via electrical wire 72. The controller 34 includes a suitable microprocessor for controlling the operation of the motor 52 and functions to generate appropriate signals to the motor 52 for rotating the drive shaft 60 in one direction to open the door 22 or the other direction for closing the door 22. The controller 34 may also function to maintain the door 22 in an open position for a selected period of time for enabling a person to pass through the door opening. The amount of time that the door 22 is held open may be varied and can be programmed into the controller 34 at the time of installation, or altered at any time thereafter by reprogramming the controller. The controller 34 may also be adjusted to generate signals that control the speed of the motor 52 for controlling the speed of opening the door 22. It is understood that although the controller 34 is shown mounted to the back plate 30, the controller 34 could also be housed internally within the wall 28, a ceiling, or remotely, such as in a mechanical room, for example. A suitable controller 34 for use with the door operator 20 described herein is well known in the art; one is available from Minarik Electric Co. of South Biloxi, Ill.

The controller 34 is part of an overall control system (not shown) which may include an input device (not shown) in electrical communication with the controller 34 for allowing a user to selectively control the delivery of electrical energy to the motor 52. The input device is operable to generate a door movement signal to the controller 34 which, in turn, is responsive to receiving the door movement signal to control operation of the motor 52 so as to selectively cause the motor 52 to rotate the drive shaft 60 and thereby effect powered opening of the door 22.

The input device may be of any known or desired type. For example, the input device may consist of a manual push pad wall switch for being mounted on the wall, or a post, adjacent to the door 22. This arrangement is such that a user, such as, for example, a handicapped person wanting to pass through the door opening need only to press the push pad for sending a signal to the controller 34 to open the door 22. Various other input devices are also suitable for use, including any type of switch, sensors and actuators, such as pressure pads as in a switch type floor mat and other mechanical switching devices, infrared motion sensors, radio frequency sensors, photoelectric cells, ultrasonic presence sensor switches, and the like. As a result of implementing some of these input devices, an automatically operable door may be caused to open by mere proximity of a person to the door. Such proximity may cause the door to operate by virtue of the interruption of a light beam, distortion of an electrical field, or by actual physical closing of the switch by contact with the person or in response to the weight of the person approaching the door. Consequently, the particular manner for generating a door movement signal to the controller 34 for energizing the motor 52 can be accomplished through any of numerous well known means.

The operator arm assembly 36 is provided for applying opening and closing force to the door. The operator arm assembly 36 includes an output shaft 80, an operator arm 82, a track 84, a roller 86, and the clutch assembly 38. The output shaft 80 is constrained to a vertical orientation by passing through bearings 90, 92 that are disposed in openings in a top brace 94 and a bottom brace 96 that are mounted to the back plate 30 with bolts 58. The output shaft 80 is coupled to the intermediate shaft 70 with an intermediate shaft bevel gear 98, fixed to the end of the intermediate shaft 70, that engages an output shaft bevel gear 100 to translate the direction of rotation 90 degrees. A set screw 102 secures the output shaft bevel gear 100 to the output shaft 80. However, it is anticipated that other forms of gearing and linkages may be used, such as worm gears, helical gears, rack and pinion arrangements and the like to translate the rotation 90 degrees. Alternative arrangements are feasible; for example, the orientation of the drive shaft 60 and the output shaft 80 axes may be parallel or coaxial.

The operator arm 82 is an elongated member that has one end that may be considered an arm hub 108, defining an opening 110 in which a bearing 112 is disposed, through which the output shaft 80 extends. An annular channel 114 surrounds the output shaft 80 at the arm hub 108. At the opposite end of the operator arm 82, the roller 86 is secured at an opening 116. The track 84 is mounted to the door 22, and the roller 86 rolls in the track 84 and may apply opening or closing force to the track 84 as the as the door 22 pivots.

Figure 3:
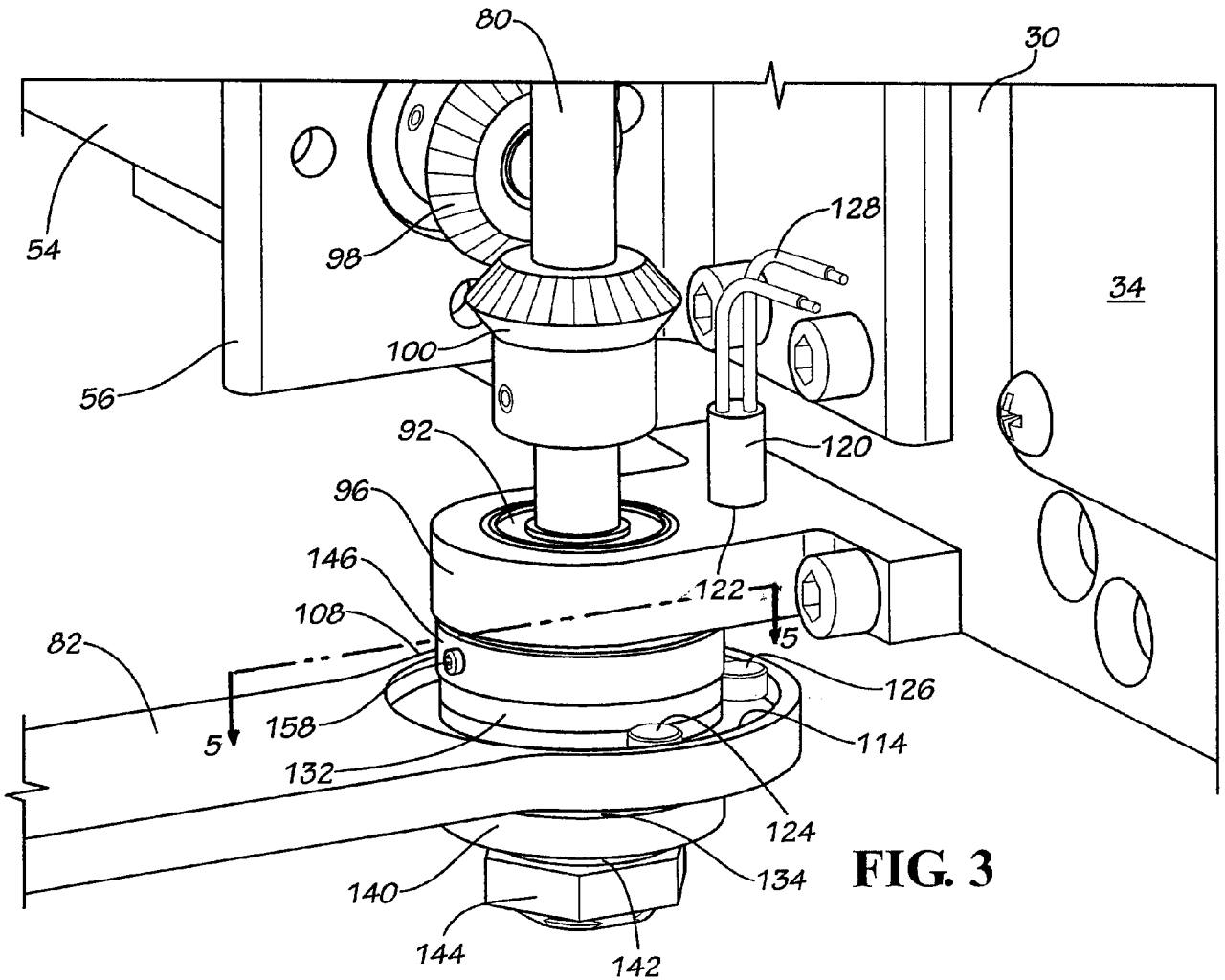
FIG. 3 is an enlarged perspective view of the opener arm assembly of FIG. 1 when an associated door is in a fully opened position.

In the embodiment shown, the bottom brace 96 also holds a door position sensor 120. As best seen in FIG. 3, the sensor 120, preferably an electro-magnetic detection device such as a reed switch, as shown, or a Hall effect sensor, extends through an opening in the bottom brace 96 to be in close proximity to the annular channel 114 of the operator arm hub. Magnets 124, 126 are disposed in the annular channel 114. One magnet 124 is positioned to be under the sensor 120 when the door 22 is closed, while the other magnet 126 is positioned to be under the sensor 120 when the door 22 is fully open; the position of the magnets 124, 126 may be altered around the annular channel 114 to adjust these door positions. By sensing when a magnet 124 is in proximity, the sensor 120 indicates to the controller 34 the status of the door position as closed, not closed, or fully open. The sensor 120 is in electrical communication with the controller 34 by means of wires 128. The sensor 120 may indicate the door position status by either sending signals or not sending signals to the controller 34 depending on the position of the door and magnets. The switch associated with the sensor 120 may be designed as either normally open or normally closed, operating by sending a signal to the controller 34 when there is a change in the magnetic field from the normal position, i.e., when the sensor 120 is actuated by a magnet, either (1) sending a signal when in the presence of a magnetic field and not sending a signal when not in the presence of a magnetic field, or (2) sending a signal when in the presence of a magnetic field and sending a signal when not in the presence of a magnetic field. It will be understood by one of ordinary skill in the art that other sensor and switch technologies may be used to indicate door position; other switches that could be used in lieu of the reed switch assembly include microswitches, limit switches, proximity switches, optical sensors, and the like.

As shown in FIG. 1, a first magnet 124 is positioned proximate to the sensor 120 when the door 22 is in the closed position. In an embodiment where the switch is designed to be normally closed, with the first magnet 124 in close proximity to the sensor 120, the sensor 120 sends a signal to the controller 34 that the door 22 is in the closed position. As the door is opened, the sensor 120 stops sending a signal. When the door 22 reaches the fully opened position, as in FIG. 3, the second magnet 126 is beneath the sensor 120, and the sensor 120 again sends a signal.

Figure 4:
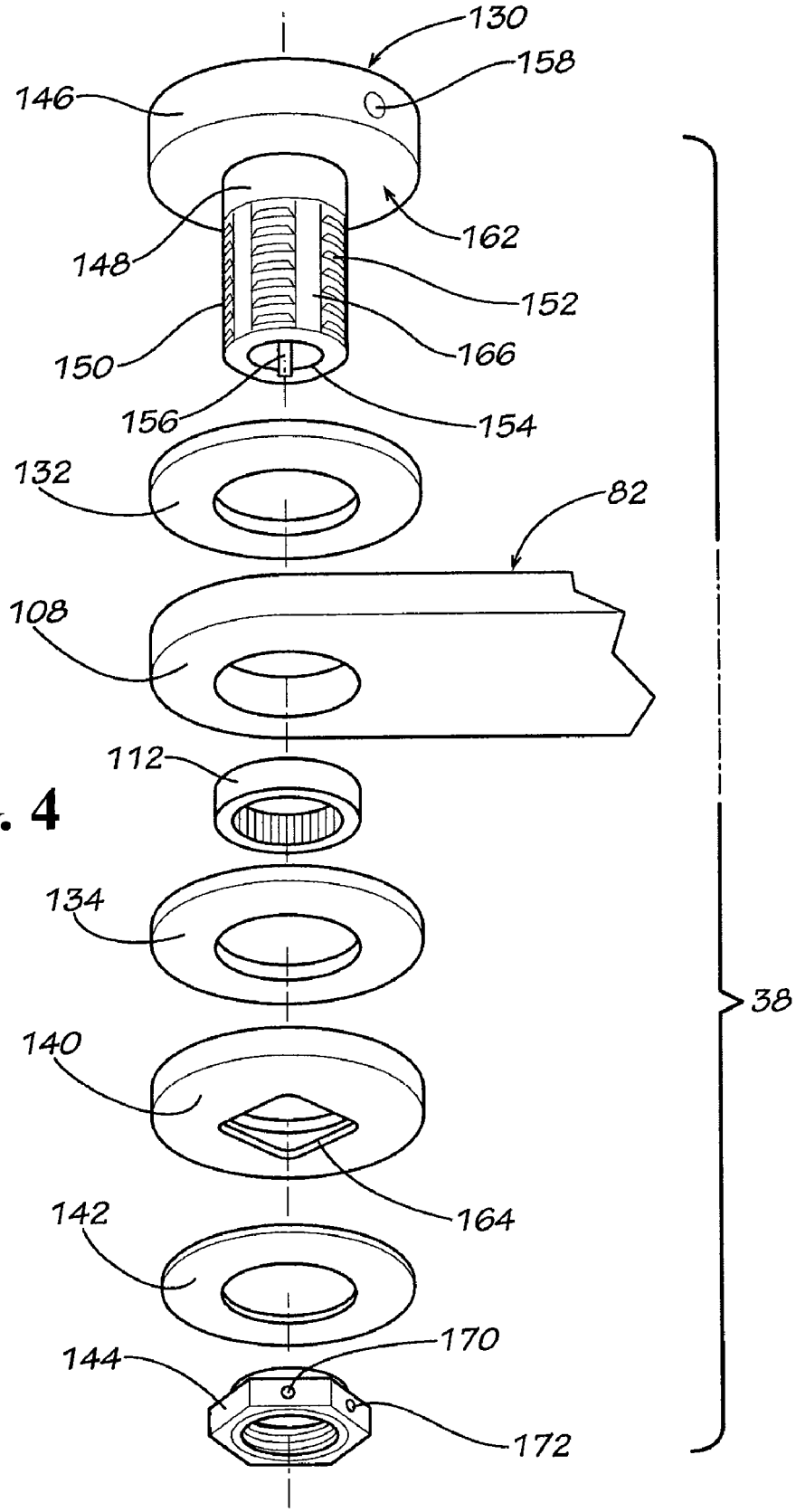
FIG. 4 is an exploded perspective view of the clutch assembly of the embodiment of FIG. 1.
Figure 5:
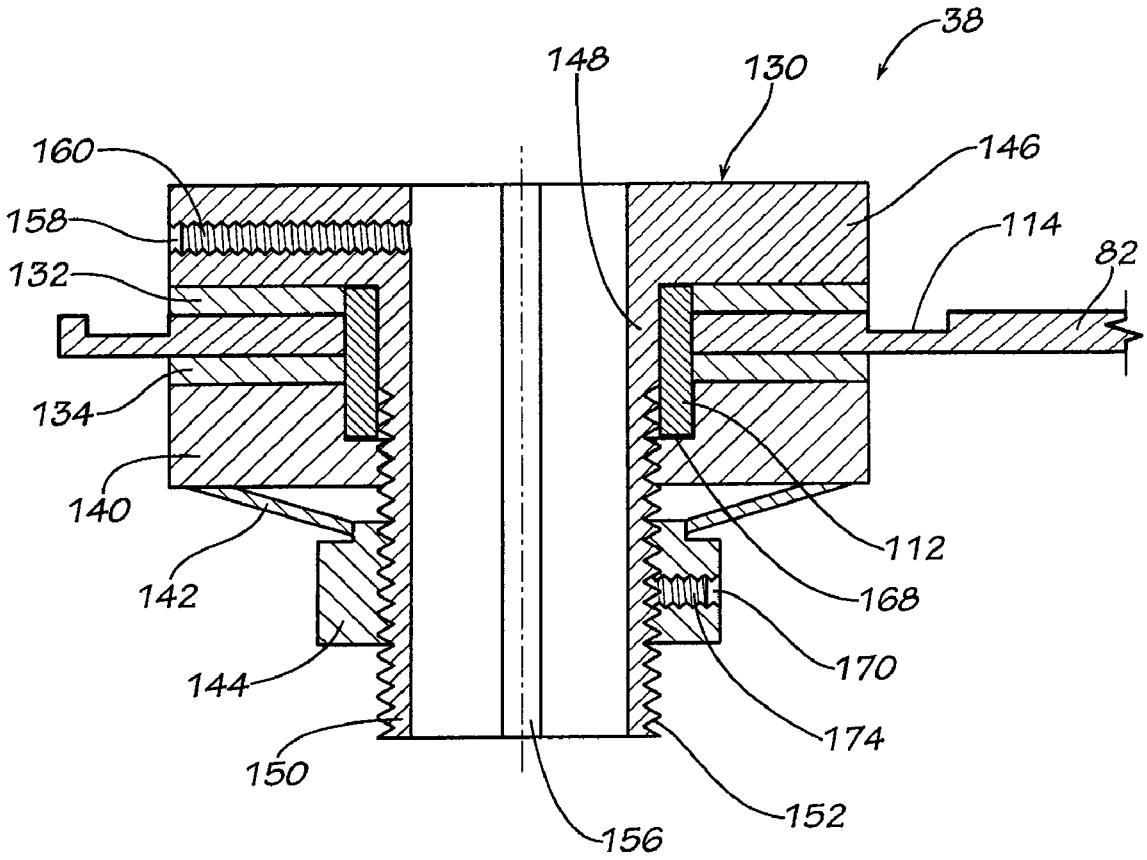
FIG. 5 is a cross-section view of the clutch assembly of FIG. 4 in an assembled configuration.

The operator arm 82 is secured to the output shaft 80 by the clutch assembly 38, which is also mounted to the output shaft 80. As most clearly shown in FIGS. 4 and 5, the clutch assembly 38 includes a clutch hub 130, a pair of friction discs 132, 134, a plate 140, a spring 142, and a retaining nut 144. The clutch hub 130 includes a first section 146, a second section 148 of reduced diameter, and a third section 150, also of reduced diameter and with threads 152. The clutch hub 130 has a cylindrical bore 154 that extends along the longitudinal axis of the clutch hub 130 and receives the output shaft 80. The hub 36 may also have a longitudinally aligned, rectangular channel-shaped groove 156 recessed in the surface of the cylindrical bore 154. The output shaft 80 may have a radially extending flange (not shown) at the lower end that is received in the groove 156, keying the output shaft 80 and the clutch hub 130 together. This keyed relationship assures that the clutch hub 130 will rotate as the output shaft 80 rotates, without slipping. There is also a threaded clutch hub bore 158 in the clutch hub first section 146. The threaded hub bore 158 receives a clutch hub set screw 160 (FIG. 2). When tightened, the clutch hub set screw 160 helps to secure the hub 36 onto the output shaft 80.

The change in diameter between the first hub section 146 and the second hub section 148 creates a shoulder 162. The shoulder 162 is sized to abut a first friction disc 132, which abuts the operator arm hub 108. A second friction disc 134 abuts the opposite side of the arm hub 108, and accordingly the arm hub 108 is sandwiched on either side by the friction discs 132, 134. Alternatively, there may be parts (not shown) between the friction discs 132, 134 and the arm hub 108. The bearing 112 is received in openings in the arm hub 108 and the friction discs 132, 134, and encircles the output shaft 80. The plate 140 is mounted adjacent to the second friction disc 134, and has a squared opening 164 that fits around the clutch hub third section 150, which has longitudinal flat surfaces 166 interrupting the threads 152. The squared opening 164 assures that the plate 140 rotates with the clutch hub 130 and output shaft 80. The plate 140 also has an inner plate shoulder 168 sized to receive the outer diameter of the bearing 112. The spring 142 is stacked adjacent to the plate 140 and is secured to the clutch hub 130 by means of the retaining nut 144. The spring 142 may be a disc spring such as a Belleville washer, which has a slight conical shape, but other biasing means may be selected as appropriate. The retaining nut 144 is threaded onto the clutch hub third section 150. There are two retaining nut threaded radial bores 170, 172 in the side of the retaining nut 144 that may receive a retaining nut set screw 174 for preventing loosening of the retaining nut 144.

The materials of the door operator 20 may generally be expected to be metal, and in particular steel alloy, but may be as selected by one of ordinary skill in the art. Bearings that encircle rotating parts may be, for example, needle bearings; one such bearing 136 appropriate for use with the clutch assembly 38 is available from The Timken Company of Canton, Ohio, acquirers of The Torrington Company, Torrington part B-16.8. Other bearing types may be used as selected by one of ordinary skill in the art. Friction discs 132, 134 have coefficients of friction which are selected in a manner well-known to those skilled in the art, to allow reliable rotation the opener arm 82 to move with the friction discs 132, 134 under powered operation and independent of the friction discs 132, 134 when an obstacle is encountered or the door 22 is manually opened, as discussed below. The friction discs 132, 134 may be made of carbon fiber and may be a material used for automotive brake pads. One clutch assembly 38 appropriate for use in the embodiment shown in the figures herein is an Overload Safety Device as manufactured by Dalton Gear Company of Minneapolis, Minn.

In use, the door 22 may be either pushed open manually or automatically opened under power of the motor, initiated by a signal sent from an input device (not shown) to the controller. If the door 22 is to be automatically opened, the controller 34, in electrical communication with the motor 52, causes the motor 52 to begin operation which results in the motor drive shaft 60 rotating in a first direction. From the closed position as shown in FIGS. 1 and 2, as the motor drive shaft 60 rotates, the rotational movement is transferred by the intermediate shaft bevel gear 98 to the output shaft bevel gear 100 and causes the output shaft 80 to rotate in a first direction. In the absence of any external force on the door, when the output shaft 80 rotates, the operator arm 82 likewise rotates, and concurrently the first magnet 124 moves away from its position proximate to the sensor 120 and the indication of door position status from the sensor 120 changes to "not closed."

When the door 22 reaches its fully opened position, the second magnet 126 is proximate to the sensor 120, as shown in FIG. 3. The presence of the magnetic field causes the sensor 120 to indicate to the controller 34 that the door 22 is in its fully opened position. At that point, the controller 34 either signals the motor 52 to reverse rotational direction of the motor drive shaft 60 or there may be a time delay prior to initiating the rotation. The time delay may be programmed into the controller circuitry and may depend on the location and use of the door 22. For example, if the door 22 is used frequently or is an entry way for a high security area, the time delay may be minimal or nonexistent. Conversely, if the doorway is an entrance to a public facility and receives a significant amount of use by people in wheelchairs, the time delay may be greater. When the rotation of the operator arm 82 returns the first magnet 124 to a position proximate to the sensor 120, as shown in FIG. 2, the sensor 120 indicates to the controller 34 that the door 22 is in the closed position. When the controller 34 receives the closed door position indication from the sensor 120, a signal is sent to the motor 52 to stop rotation of the motor drive shaft 60.

Alternatively, the door 22 may be pushed open manually. The clutch assembly 38 with friction discs 132, 134 permits a user to push the door 22 open without having to rotate the motor drive shaft 60, which poses significant force requirements. Instead, the user must only overcome the force of static friction between one or more of the operator arm hub 108, the clutch hub 130, and the plate 140 with the friction discs 132, 134 and once the door 22 is moving, the reduced force of sliding friction between the same parts. Preferably, the clutch assembly 38 may be designed so that the amount of force required to overcome the frictional force of the discs 132, 134 and adjacent parts may be easily accomplished by an average person. The appropriate frictional force may be achieved by the selection of the spring 142 and by the amount of torque applied to the retaining nut 144. One method of applying the correct amount of torque may be by an installer adjusting the torque by trial and error to reach the setting where one or both of the friction discs 132, 134 will slide against an adjacent part when a user pushes the door 22 open, but otherwise the friction discs 132, 134 will engage adjacent parts to allow the motor assembly 32 to drive the door 22.

When the door 22 is pushed open, the sensor 120 indicates to the controller 34 that the door 22 is not in the closed position, and the controller 34 identifies that there has been no signal from the input device, meaning that the door 22 is being opened manually. The controller 34 then sends a signal to the motor 52 to rotate the motor drive shaft 60 in the direction that will close the door 22. The force applied by the person to open the door 22 exceeds the force of sliding friction in the clutch hub 130 and the operator arm hub 108, so the person can continue to open the door 22 as necessary. When the person passes through the door 22 and releases the door 22, the friction discs 132, 134 resume connection with the opener arm 82 and the door 22 begins to close immediately.

In the event of an obstruction in the path of the door movement during powered opening or closing, the force needed to overcome the static friction of the friction discs 132, 134 on the opener arm 82 may be overcome and optimally the door 22 is able to cease movement quickly without damage to the obstructing object.

Figure 6:
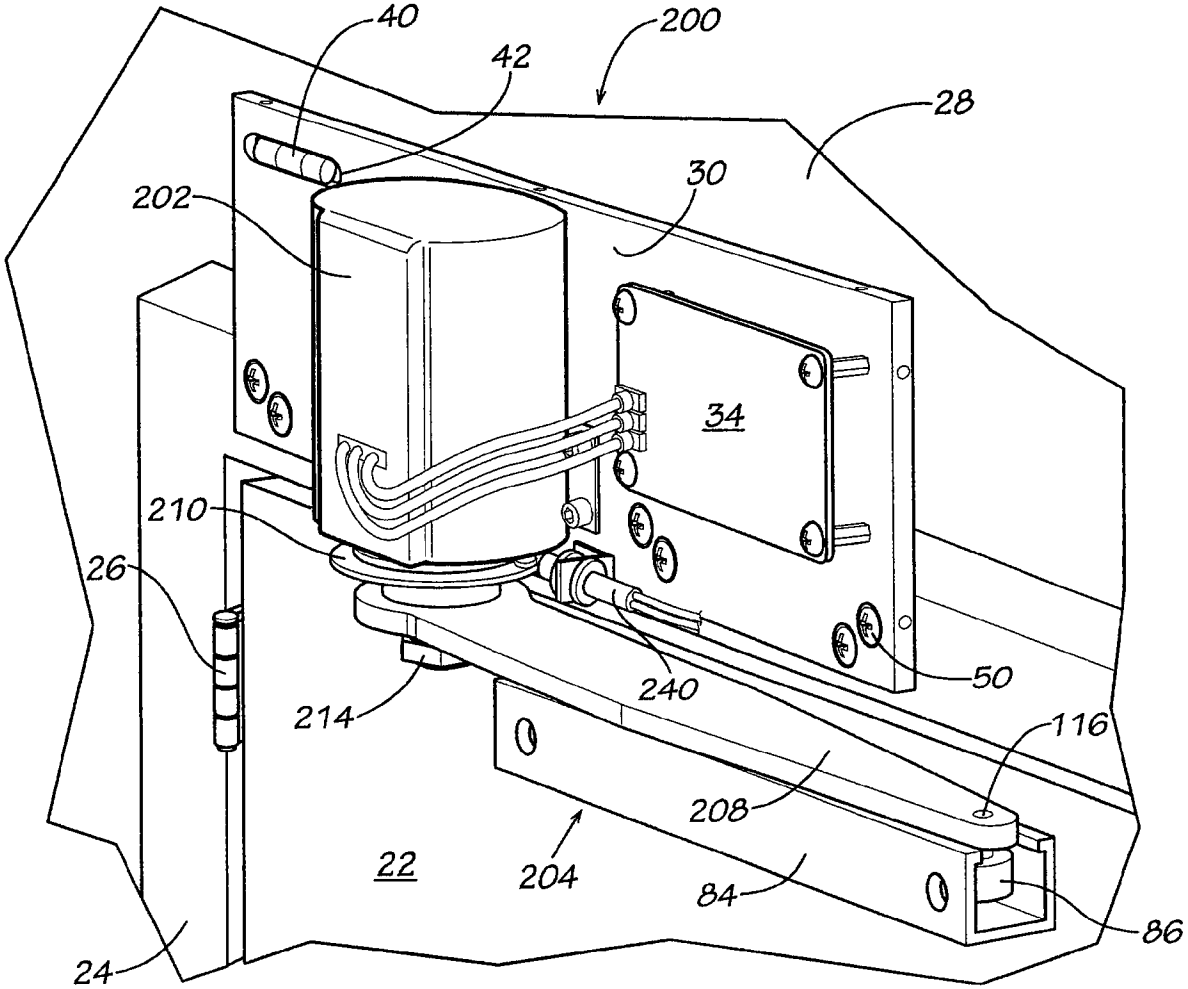
FIG. 6 is a perspective view of another embodiment of an automatic door opener system.
Figure 7:
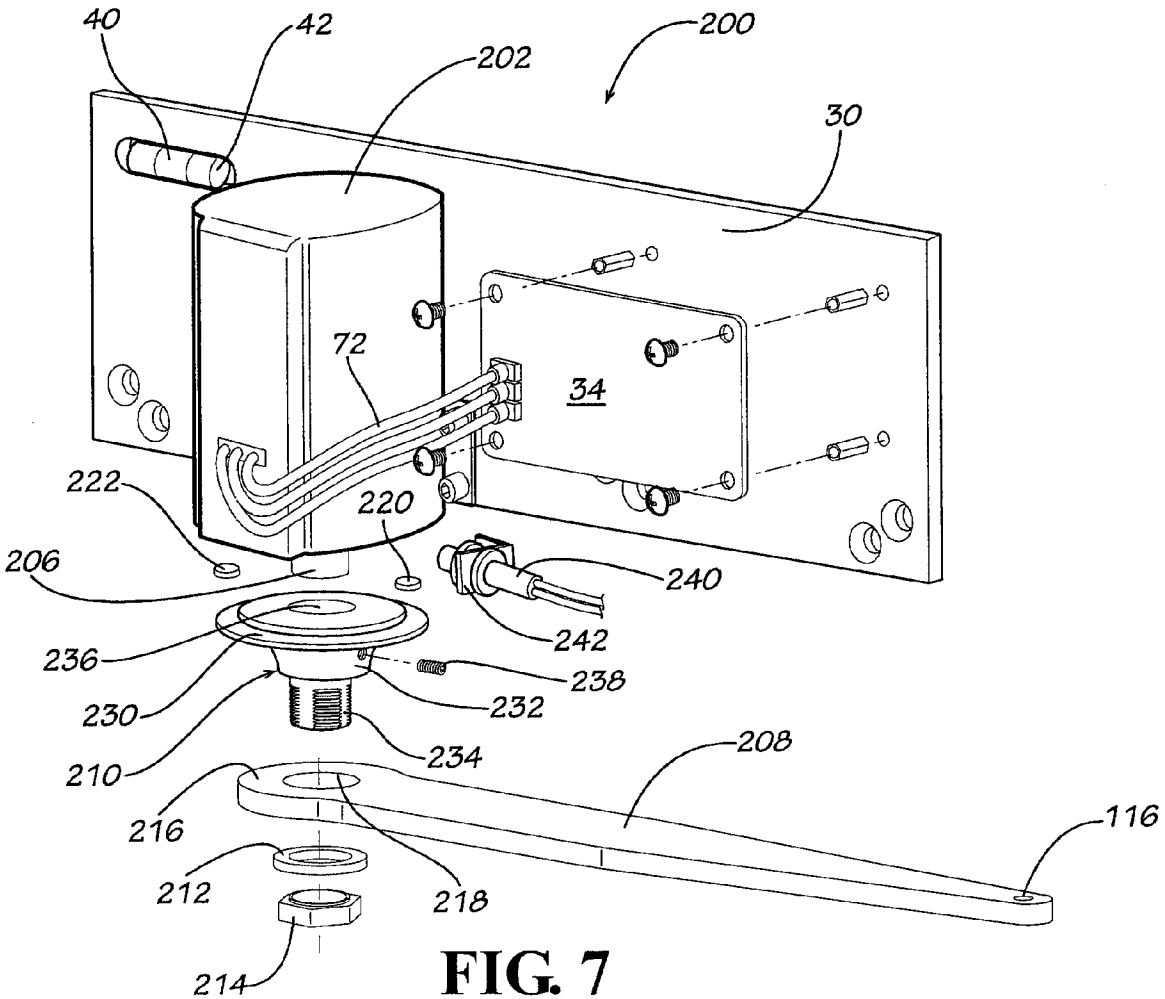
FIG. 7 is an exploded view of the embodiment of FIG. 6.
Figure 8:
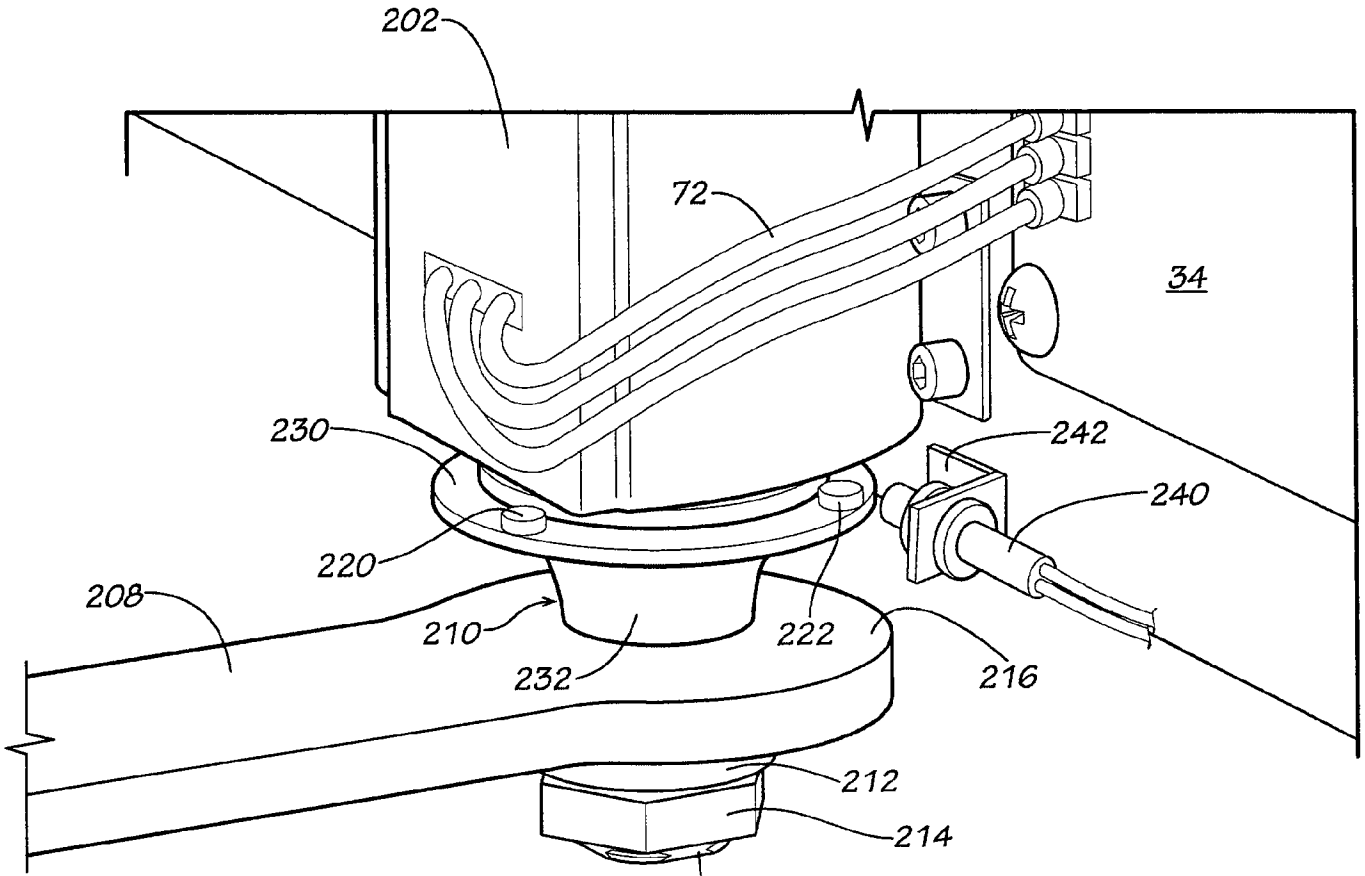
FIG. 8 is an enlarged perspective view of the opener arm assembly of FIG. 6 when an associated door is in a fully opened position.

FIGS. 6-8 show another embodiment of a door operator 200. The door operator 200 includes a back plate 30, a motor 202, a controller 34, and an operator arm assembly 204. The motor may be similar to the motor 52 of FIGS. 1 and 2, as selected by one of ordinary skill in the art, but is vertically oriented and in one embodiment may provide 1/75 HP and have a 200:1 gear ratio. The vertical orientation of the motor 202 eliminates the need that exists in the embodiment of FIGS. 1-5 to translate the direction of rotation of the motor shaft 60 to the output shaft 80, and makes it possible to shorten the back plate 30 if desired. The motor shaft 206 extends directly to the operator arm assembly 204.

The operator arm assembly 204 includes an operator arm 208, a track 82, a roller 86, a magnet holder 210, a washer 212, and a nut 214. The operator arm 208 has an arm hub 216 defining an opening 218 through which the motor shaft 206 and magnet holder 210 extend, and is similar to the operator arm 82 of FIGS. 1-3 but lacks an annular channel 114. Instead, magnets 220, 222 may be disposed on the magnet holder 210, which includes an annular shelf 230 at one end, a tapered neck 232 beneath the annular shelf 230, and an externally threaded stem 234 extending from the neck 232. An axial cylindrical bore 236 passes through the magnet holder 210, and an internal longitudinal channel, not shown, may be provided to mate with a key, also not shown, on the motor shaft 206, which consequently requires the magnet holder 210 to turn with the motor shaft 206 without slipping. A set screw 238 in a radial opening in the magnet holder 210 also secures the magnet holder 210 to the motor shaft 206. The magnet holder stem 234 passes through the operator arm opening 218 and the washer 212, and the nut 214 is threaded onto the stem 234 to secure the arm 208 to the magnet holder 210.

A door position sensor 240 is mounted to the back plate 30 with a bracket 242. The sensor 240 design and operation is similar to the sensor 120 of the door operator 20 of FIGS. 1-5, but the sensor 240 is mounted horizontally to detect the presence of the magnets 220, 222 on the shelf 230 of the magnet holder 210. One magnet 220 is positioned to be in close proximity to the sensor 240 when the door 22 is closed, while the other magnet 222 is positioned to be proximate to the sensor when the door 22 is fully open. The position of the magnets 220, 222 may be altered around the shelf 230 to adjust these door positions. With the operator arm 208 in the closed position as in FIGS. 6 and 7, the first magnet 220 is proximate to the sensor 240; with the operator arm 208 in the fully open position as in FIG. 8, the second magnet 222 is proximate to the sensor 240.

Although the embodiments described above have been shown and described in considerable detail with respect to only a few exemplary embodiments thereof, it should be understood by those skilled in the art that it is not intended to be limited to these embodiments since various modifications, omissions and additions may be made to the disclosed embodiments without materially departing from the novel teachings and advantages. For example, some of the novel features could be used with any type of powered door operator. Accordingly, it is intended to cover all such modifications, omission, additions and equivalents as may be included within the spirit and scope of a door operator and associated methods as defined by the following claims. In the claims, means-plus-function clauses are intended to cover the structures described herein as performing the recited function and not only structural equivalents but also equivalent structures.

Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door;

a rotatable operator arm defining an opening through which the shaft passes and adapted to be operatively connected to the door, wherein the operator arm is adapted to have a closed position coincident with the closed position of the door and a fully open position coincident with the fully open position of the door; and a clutch assembly mounted to the shaft and conditionally operatively engageable with the operator arm, wherein when a force is manually applied to move the operator arm towards the fully open position the shaft and operator arm are not operatively engaged and rotate independently of each other, and when no manual force is applied the shaft and the operator arm are operatively engaged and rotate together.

2. The door operator of claim 1, further comprising:

a support member for directly or indirectly supporting the motor and that is adapted to be mounted to a door frame or structure proximate to the door frame; and a bubble level mounted to the support member.

3. The door operator of claim 2, wherein the support member defines a recess in which at least a portion of the bubble level is received.

4. The door operator of claim 3, wherein the support member has a front face adapted to face away from the door frame or structure and the recess is defined in the front face.

5. The door operator of claim 1, further comprising:

a door position sensor for sensing the position of the operator arm; and a controller in communication with the motor and the door position sensor, wherein when the operator arm is manually moved towards the fully open position from the closed position, the operator arm operatively disengages from the clutch assembly, the sensor indicates to the controller that the operator arm position is not closed, the controller signals to the motor to rotate the shaft in the direction adapted to close the door, and the motor rotates the shaft in the direction adapted to close the door.

6. The door operator of claim 5, wherein when force is no longer applied to move the operator towards the fully open position manually, the operator arm operatively reengages with the clutch assembly and the operator arm begins to move towards the closed position.

7. The door operator of claim 6, wherein the clutch assembly comprises at least one friction disc on each side of the operator arm.

8. The door operator of claim 7, wherein at least one friction disc is adjacent to the operator arm.

9. The door operator of claim 7, wherein at last one part other than one of the friction discs is adjacent to the operator arm.

10. The door operator of claim 5, wherein the door position sensor is an electro-magnetic sensor, and further comprising a first magnet that rotates about the axis of the shaft.

11. The door operator of claim 10, wherein the first magnet demarcates the closed position of the operator arm.

12. The door operator of claim 11, further comprising a second magnet that rotates about the axis of the shaft and is angularly spaced from the first magnet relative to the central axis of the shaft, wherein the second magnet demarcates the fully open position of the operator arm.

13. The door operator of claim 12, wherein the first and second magnets are disposed on the operator arm.

14. The door operator of claim 12, wherein the operator arm defines an annular channel that encircles the shaft, and the first and second magnets are disposed in the channel.

15. The door operator of claim 5, wherein when the controller receives a signal for the door operator to move the operator arm towards the fully open position automatically and the motor powers the operator arm to reach a fully open position, the door position sensor indicates to the controller that the operator arm is in the fully opened position and the controller, either immediately or after a delay, sends a signal to the motor to reverse rotation of the shaft so as to cause the operator arm to move to the closed position, the door position sensor indicates to the controller when the operator arm is in the closed position, and the controller sends a signal to the motor to cease rotation of the shaft.

16. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door;

a rotatable operator arm defining an opening through which the shaft passes and adapted to be operatively connected to the door, wherein the operator arm is adapted to have a closed position coincident with the closed position of the door and a fully open position coincident with the fully open position of the door;

a clutch assembly mounted to the shaft and conditionally operatively engageable with the operator arm, wherein the clutch assembly comprises at least one friction disc on each side of the operator arm and a spring disposed around the shaft, wherein the spring biases the friction discs and the operator arm towards each other, and wherein when a force is manually applied to move the operator arm towards the fully open position the shaft and operator arm are not operatively engaged, and when no manual force is applied the shaft and the operator arm are operatively engaged;

a door position sensor for sensing the position of the operator arm; and a controller in communication with the motor and the door position sensor, wherein when the operator arm is manually moved towards the fully open position from the closed position, the operator arm operatively disengages from the clutch assembly, the sensor indicates to the controller that the operator arm position is not closed, the controller signals to the motor to rotate the shaft in the direction adapted to close the door, and the motor rotates the shaft in the direction adapted to close the door, and wherein when force is no longer applied to move the operator towards the fully open position manually, the operator arm operatively reengages with the clutch assembly and the operator arm begins to move towards the closed position.

17. The door operator of claim 16, wherein the clutch assembly further comprises a retaining nut that applies adjustable force to the spring.

18. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door;

a rotatable operator arm defining an opening through which the shaft passes and adapted to be operatively connected to the door, wherein the operator arm is adapted to have a closed position coincident with the closed position of the door and a fully open position coincident with the fully open position of the door; and a clutch assembly mounted to the shaft and conditionally operatively engageable with the operator arm, wherein when a force is manually applied to move the operator arm towards the fully open position the shaft and operator arm are not operatively engaged, and when no manual force is applied the shaft and the operator arm are operatively engaged;

a first magnet that rotates about the axis of the shaft;

a second magnet that rotates about the axis of the shaft and is angularly spaced from the first magnet relative to the central axis of the shaft;

a magnet holding member mounted to the shaft that rotates about the axis of the shaft as the operator arm moves and on which the first and second magnets are disposed;

a door position sensor for sensing the position of the operator arm; and a controller in communication with the motor and the door position sensor, wherein when the operator arm is manually moved towards the fully open position from the closed position, the operator arm operatively disengages from the clutch assembly, the sensor indicates to the controller that the operator arm position is not closed, the controller signals to the motor to rotate the shaft in the direction adapted to close the door, and the motor rotates the shaft in the direction adapted to close the door, wherein the door position sensor is an electro-magnetic sensor, wherein the first magnet demarcates the closed position of the operator arm, and wherein the second magnet demarcates the fully open position of the operator arm.

19. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door;

a rotatable operator arm defining an opening through which the shaft passes and adapted to be operatively connected to the door, wherein the operator arm is adapted to have a closed position coincident with the closed position of the door and a fully open position coincident with the fully open position of the door; and means for conditionally operatively engaging the shaft with the operator arm, wherein when a force is manually applied to move the operator arm towards the fully open position the shaft and operator arm are not operatively engaged, and when no manual force is applied the shaft and the operator arm are operatively engaged; and a controller in communication with the motor and the sensing means, wherein the means for conditionally operatively engaging the shaft with the operator arm comprises a clutch assembly including at least one friction disc on each side of the operator arm and a spring for biasing the friction discs and the operator arm towards each other for transfer of rotation of the shaft to the operator arm through static friction.

20. The door operator of claim 19, wherein at least one friction disc is adjacent to the operator arm.

21. The door operator of claim 19, wherein at last one part other than one of the friction discs is adjacent to the operator arm.

22. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door; and a rotatable operator arm defining an opening through which the shaft passes and adapted to be operatively connected to the door, wherein the operator arm is adapted to have a closed position coincident with the closed position of the door and a fully open position coincident with the fully open position of the door;

an electro-magnetic door position sensor for sensing the position of the operator arm;

a first magnet that rotates about the axis of the shaft wherein the first magnet demarcates the closed position of the operator arm; and a controller in communication with the motor and the door position sensor.

23. The door operator of claim 22, further comprising a second magnet that rotates about the axis of the shaft and is angularly spaced from the first magnet relative to the axis of the shaft, wherein the second magnet demarcates the fully open position of the operator arm.

24. The door operator of claim 23, wherein the first and second magnets are disposed on the operator arm.

25. The door operator of claim 23, wherein the operator arm defines an annular channel that encircles the shaft, and the first and second magnets are disposed in the channel.

26. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door; and a rotatable operator arm defining an opening through which the shaft passes and adapted to be operatively connected to the door, wherein the operator arm is adapted to have a closed position coincident with the closed position of the door and a fully open position coincident with the fully open position of the door;

an electro-magnetic door position sensor for sensing the position of the operator arm;

a first magnet that rotates about the axis of the shaft wherein the first magnet demarcates the closed position of the operator arm;

a second magnet that rotates about the axis of the shaft and is angularly spaced from the first magnet relative to the axis of the shaft, wherein the second magnet demarcates the fully open position of the operator arm;

a magnet holding member mounted to the shaft that rotates about the axis of the shaft as the operator arm moves and on which the first and second magnets are disposed; and a controller in communication with the motor and the door position sensor.

27. A door operator for selectively operating a door positioned within a door frame and hinged along one edge to the door frame for movement between a closed position and a fully open position, the door operator comprising:

a motor; and an operator arm assembly including:

a shaft operatively coupled to the motor, the shaft rotatable in a first direction adapted to open the door and in a second direction adapted to close the door; and a rotatable operator arm defining an opening through which the shaft passes and adapted to be operatively connected to the door, wherein the operator arm is adapted to have a closed position coincident with the closed position of the door and a fully open position coincident with the fully open position of the door;

a support member for directly or indirectly supporting the operator arm assembly and that is adapted to be mounted to a door frame or structure proximate to the door frame; and a bubble level mounted to the support member, wherein the support member defines a recess in which at least a portion of the bubble level is received.

28. The door operator of claim 27, wherein the support member has a front face adapted to face away from the door frame or structure and the recess is defined in the front face.

29. A door assembly, comprising:

a door positioned within a door frame and hinged along one edge to the door frame for movement between a closed position and a fully open position; and a door operator comprising:

a motor; and an operator arm assembly including:

a shaft operatively coupled to the motor, the shaft rotatable in a first direction adapted to open the door and in a second direction adapted to close the door;

a rotatable operator arm defining an opening through which the shaft passes, the operator arm operatively connected to the door; and a clutch assembly mounted to the shaft and conditionally operatively engageable with the operator arm, the clutch assembly including at least one friction disc on each side of the operator arm and a spring for biasing the friction discs and the operator arm towards each other for transfer of rotation of the shaft to the operator arm through static friction;

a door position sensor for sensing the position of the operator arm; and a controller in communication with the motor and the sensor, wherein when the door is manually pushed open from the closed position, the operator arm rotates relative to the friction discs, the door position sensor indicates to the controller that the door is not closed, the controller signals to the motor to rotate the shaft in the direction that closes the door, and the motor rotates the shaft in such direction.

30. The door assembly of claim 29, wherein the door position sensor is also for sensing the position of the door as fully open, and wherein when the controller receives a signal initiating powered opening of the door, the controller signals to the motor to rotate the shaft in the direction that opens the door, and the motor rotates the shaft in the direction that opens the door until the sensor indicates to the controller that the door is fully open, at which time the controller sends a signal to the motor that stops rotation of the shaft in the direction that opens the door.

31. The door operator of claim 29, wherein at least one friction disc is adjacent to the operator arm.

32. The door operator of claim 29, wherein at last one part other than one of the friction discs is adjacent to the operator arm.

* * * * *

UNITED STATES PATENT AND TRADEMARK OFFICE

CERTIFICATE OF CORRECTION

PATENT NO. : 8,407,937 B2
APPLICATION NO. : 12/603871
DATED : April 2, 2013
INVENTOR(S) : Blue Houser It is certified that error appears in the above-identified patent and that said Letters Patent is hereby corrected as shown below:

In the Claims

Column 13, Line 65, Claim 9: "wherein at last one part" should be changed to --wherein at least one part--.

Column 16, Line 24, Claim 21: "wherein at last one part" should be changed to --wherein at least one part--.

Column 18, Line 43, Claim 32: "wherein at last one part" should be changed to --wherein at least one part--.

Signed and Sealed this
First Day of July, 2014

Michelle K. Lee

Michelle K. Lee
*Deputy Director of the United States Patent and Trademark Office*